US005365905A

United States Patent [19]

Kanehiro et al.

[11] Patent Number: 5,365,905

[45] Date of Patent: Nov. 22, 1994

[54] MISFIRE-DETECTING SYSTEM FOR INTERNAL COMBUSTION ENGINES

[75] Inventors: Masaki Kanehiro; Yuichi Shimasaki; Takuji Ishioka; Shigeru Maruyama; Shigeki Baba; Takashi Hisaki; Kenichi Maeda; Kazutomo Sawamura; Jiro Takagi; Shukoh Terata, all of Wako, Japan

[73] Assignee: Honda Giken Kogyo Kabushiki Kaisha, Tokyo, Japan

[21] Appl. No.: 27,492

[22] Filed: Mar. 5, 1993

[30] Foreign Application Priority Data

| | | | |
|---|---|---|---|
| Mar. 13, 1992 | [JP] | Japan | 4-89401 |
| Mar. 16, 1992 | [JP] | Japan | 4-90358 |
| Jan. 14, 1993 | [JP] | Japan | 5-22087 |

[51] Int. Cl.[5] ..... F02P 17/00

[52] U.S. Cl. ..... 123/406

[58] Field of Search ..... 123/406, 418, 198 DB, 123/630, 424, 426

[56] References Cited

U.S. PATENT DOCUMENTS

| | | | |
|---|---|---|---|
| 4,886,029 | 12/1989 | Lill et al. | 123/630 |
| 4,913,123 | 4/1990 | DeBiasi et al. | 123/426 |
| 5,215,067 | 6/1993 | Shimasaki et al. | 123/630 |
| 5,221,904 | 6/1993 | Shimasaki et al. | 123/479 |
| 5,226,394 | 7/1993 | Shimasaki et al. | 123/479 |
| 5,241,937 | 9/1993 | Kanehiro et al. | 123/630 |
| 5,303,158 | 4/1994 | Kuroda | 123/419 |

*Primary Examiner*—David A. Okonsky

*Attorney, Agent, or Firm*—Nikaido, Marmelstein, Murray & Oram

[57] ABSTRACT

A misfire-detecting system for an internal combustion engine in which a value of sparking voltage is detected, which is generated across a spare plug when high voltage is generated by an ignition device in response to generation of an ignition command signal. When a time period over which the detected value of sparking voltage exceeds a predetermined reference voltage value exceeds a predetermined time period value, the system determines that a misfire has occurred in the engine. A recharging command signal is generated for applying high voltage to the spark plug, after generation of the ignition command signal. As a result, a misfire can be accurately detected.

22 Claims, 15 Drawing Sheets

T1
T2
A
t0
t1
t2
G

TG
t3
t4
V
VCOMP
C

B
0
t0
t5
t2 t6
t7
t2
t8
VT
VTREF 0
t3
t4
V
VCOMP
C'

B'
0
t0
t9
t10
t5
t2
t11 t9
t10
t2
t11
VT

VTREF
0
t3
t4 t12
t4

T1
T2
A
t0
t1 t2
G

TG
t3
t4
V
VCOMP
C

B
0
t0
t5 t2 t6 t7
t2 t8
VT
VTREF 0
t3,t2
t4
V
VCOMP
C'

B'
0
t0
t9
t10 t5 t2
t11 t9
t10 t2
t11
VT
VTREF 0
t3,t2
t4 t12
t4

TA
T1
T2
A
G
TG
V
VCOMP
0
C
B
VT
C'
B'
t0
t1
t2
t3
t4
t5
t6
t7
t8
t9
t10
t11
t12

MISFIRE-DETECTING SYSTEM FOR INTERNAL COMBUSTION ENGINES

BACKGROUND OF THE INVENTION

1. Field of the Invention

This invention relates to a misfire-detecting system for internal combustion engines, and more particularly to a misfire-detecting system of this kind, which is adapted to detect a misfire attributable to the fuel supply system.

2. Prior Art

In an internal combustion engine having spark plugs, a misfire can occur, in which normal ignition does not take place at one or more of the spark plugs. Misfires are largely classified into ones attributable to the fuel supply system and ones attributable to the ignition system. Misfires attributable to the fuel supply system are caused by the supply of a lean mixture or a rich mixture to the engine, while misfires attributable to the ignition system are caused by failure to spark (so-called missparking), i.e. normal spark discharge does not take place at the spark plug, for example, due to smoking or wetting of the spark plug with fuel, particularly adhesion of carbon in the fuel or unburnt fuel to the spark plug, or abnormality in the sparking voltage supply system.

The present assignee has already proposed a misfire-detecting system for detecting misfires attributable to the fuel supply system, which comprises sparking voltage detecting means which detects sparking voltage, i.e. voltage across electrodes of the spark plug, and misfire-determining means which determines that a misfire has occurred when a time period over which the detected value of the sparking voltage exceeds a predetermined reference value (Japanese Patent Application No. 3(1991)-326507 and corresponding U.S. Ser. No. 07/846,238 filed Mar. 5, 1992).

In the above proposed system, the time period over which the detected value of sparking voltage exceeds the predetermined reference value corresponds to a time period over which a predetermined amount of electric charge or more is stored in floating capacitance in the vicinity of the spark plug. Depending upon the behavior of discharge caused by sparking of the spark plug, the charge can be discharged within a short time period even if a misfire has occurred. This phenomenon can take place when the sparking voltage assumes a considerably high voltage value at the end of an inductive discharge caused by sparking, due to occurrence of a misfire. In such an event, discharge again takes place between the electrodes of the spark plug and terminates within a short time period so that the misfire is not detected to have occurred.

Further, even in the case where the spark plug has just started smoking due to adhesion of carbon, etc. to the electrodes of the spark plug and hence has decreased insulation resistance between the electrodes, or in the case where the spark plug has just started recovering from its smoking state due to its own purifying action, dielectric breakdown is likely to occur so that there is no significant difference in the time period over which the sparking voltage exceeds the predetermined reference value between when normal firing has occurred and when a misfire has occurred.

SUMMARY OF THE INVENTION

It is an object of the invention to provide a misfire-detecting system for an internal combustion engine, which is capable of accurately detecting a misfire attributable to the fuel supply system even when the sparking voltage assumes a considerably high voltage value due to occurrence of a misfire.

It is a further object of the invention to provide a misfire-detecting system which is capable of accurately determining occurrence of a misfire attributable to the fuel supply system even when the spark plug has just been brought into a smoking state.

To attain the first-mentioned object, the present invention provides a misfire-detecting system for detecting a misfire occurring in an internal combustion engine having at least one cylinder, and a spark plug provided in each of the at least one cylinder, engine operating condition-detecting means for detecting values of operating parameters of the engine, signal-generating means for determining ignition timing of the engine, based upon values of operating parameters of the engine detected by the engine operating condition-detecting means and generating an ignition command signal indicative of the determined ignition timing, and sparking voltage-generating means responsive to the ignition command signal for generating a high voltage for discharging the spark plug, voltage value-detecting means for detecting a value of sparking voltage generated across the spark plug when the high voltage is generated by the sparking voltage-generating means, comparing means for comparing between the detected sparking voltage value and a predetermined reference voltage value, measuring means for measuring a time period over which the detected sparking voltage exceeds the predetermined reference voltage value, and misfire-determining means for determining that a misfire has occurred in the engine, when the measured time period exceeds a predetermined time period.

The misfire-detecting system according to the invention is characterized by comprising recharging command signal-generating means for generating a recharging command signal for applying high voltage to the spark plug, after generation of the ignition command signal.

With the above arrangement, electric charge is charged into peripheral circuit parts of the spark plug by the recharging command signal generated after generation of the ignition command signal, and the charged electric charge is held as it is over a considerably long time period when a misfire has occurred, to thereby accurately determine occurrence of a misfire, based upon the time period over which the sparking voltage exceeds the predetermined reference voltage value. This result is remarkable particularly when the electric charge stored in the peripheral circuit parts of the spark plug is discharged at an early time due to generation of a high sparking voltage caused by occurrence of a misfire.

Preferably, the misfire-detecting system includes time period-limiting means for setting a comparison time period within which the comparison between the detected value of sparking voltage and the predetermined reference voltage value is to be made, and wherein the misfire-determining means determines whether a misfire has occurred in the engine, based upon the measured time period obtained within the comparison time period.

Further preferably, the recharging command signal-generating means generates the recharging command signal within the comparison time period.

In another form of the invention, there is a misfire-detecting system for detecting a misfire occurring in an internal combustion engine having at least one cylinder, and a spark plug provided in each of the at least one cylinder, engine operating condition-detecting means for detecting values of operating parameters of the engine, signal-generating means for determining ignition timing of the engine, based upon values of operating parameters of the engine detected by the engine operating condition-detecting means and generating an ignition command signal indicative of the determined ignition timing, and sparking voltage-generating means responsive to the ignition command signal for generating a high voltage for discharging the spark plug, voltage value-detecting means for detecting a value of sparking voltage generated across the spark plug when the high voltage is generated by the sparking voltage-generating means, comparing means for comparing between the detected sparking voltage value and a predetermined reference voltage value, and misfire-determining means for determining that a misfire has occurred in the engine, when the sparking voltage exceeds the predetermined reference voltage value.

The misfire-detecting system according to the invention is characterized by comprising:

recharging command signal-generating means for generating a recharging command signal for applying high voltage to the spark plug, after generation of the ignition command signal; and time period-limiting means for setting a comparison time period within which the comparison between the detected value of the sparking voltage and the predetermined reference voltage value is to be made, after generation of the recharging command signal.

With this arrangement, the comparison between the sparking voltage and the predetermined reference voltage value is made after generation of the recharging command signal, and when the sparking voltage exceeds the predetermined reference voltage value, it is determined that a misfire has occurred in the engine. Therefore, a similar result to that mentioned above can be obtained, and besides, the circuit construction can be simplified.

Preferably, the time period-limiting means sets starting timing of the comparison time period such that it starts when a predetermined time period elapses after generation of the recharging command signal.

Also preferably, the time period-limiting means sets at least one of starting timing and terminating timing of the comparison time period in dependence on values of predetermined operating parameters of the engine. As a result, more accurate misfire determination can be achieved over a wide range of engine operation.

Further preferably, the recharging command signal-generating means sets a time period between generation of the ignition command signal and generation of the recharging command signal in dependence on values of predetermined operating parameters of the engine. As a result, more accurate misfire determination can be achieved over a wide range of engine operation.

The recharging command signal causes generation of a predetermined voltage across the spark plug, which has such a value as does not cause spark discharge. This can prevent an error in the misfire determination, which would otherwise be caused by spark discharge.

More preferably, the value of the predetermined voltage is set in dependence on values of predetermined operating parameters of the engine. As a result, more accurate misfire determination can be achieved over a wide range of engine operation.

The predetermined time period with which is compared the time period over which the sparking voltage exceeds the predetermined reference voltage value is set in dependence on a value of a battery which supplies operating voltage to the misfire-detecting system. As a result, accurate misfire determination can be achieved irrespective of a change in the battery voltage.

Preferably, the igniting means includes a distributor having a plurality of segments corresponding, respectively, to cylinders of the engine, and a rotor being rotatable in unison with rotation of the engine, the rotor having a circumferential size which is enlarged in a direction of retarding the ignition timing of the engine. As a result, more accurate misfire determination can be achieved over a wide range of engine operation.

A misfire-detecting system according to another aspect of the invention comprises:

recharging command signal-generating means for generating a recharging command signal for applying high voltage to the spark plug, after generation of the ignition command signal; and initializing means for initializing the predetermined reference voltage value almost simultaneously with generation of the recharging command signal.

With this arrangement, the predetermined reference voltage value can be set to a proper value so that a misfire determination can be carried out with accuracy based upon the time period over which the sparking voltage exceeds the predetermined reference voltage value.

A misfire-detecting system according to a further aspect of the invention comprises:

recharging command signal-generating means for generating a recharging command signal for applying high voltage to the spark plug, after generation of the ignition command signal; and initializing means for initializing the predetermined reference voltage value when a predetermined time period elapses after generation of the recharging command signal.

With this arrangement, the predetermined reference voltage value can be set to a further proper value so that a misfire determination can be carried out with accuracy even when the spark plug has just started smoking or just started recovering from a smoking state.

The above and other objects, features, and advantages of the invention will become more apparent from the following detailed description taken in conjunction with the accompanying drawings.

BRIEF DESCRIPTION OF THE DRAWINGS

FIGS. 5 (*a*) to (*i*) form together a timing chart showing changes in the sparking voltage occurring at normal firing and those occurring at a misfire, in which:

FIG. 5 (*a*) shows an energization control signal A;

FIG. 5 (*b*) shows a gating signal G;

FIG. 5 (*c*) shows changes in a comparative level VCOMP at normal firing to be compared with sparking voltage V;

FIG. 5 (*d*) shows an output from a first comparator in FIG. 2;

FIG. 5 (*e*) shows an output from a pulse duration-measuring circuit in FIG. 2;

FIG. 5 (*f*) shows changes in the comparative level VCOMP at a misfire;

FIG. 5 (*g*) shows an output from the first comparator, which is obtained at the misfire;

FIG. 5 (*h*) shows an output from the pulse duration-measuring circuit, which is obtained at the misfire; and FIG. 5 (*i*) shows an output from a second comparator in FIG. 2, which is obtained at the misfire;

FIG. 8 (*b*) shows a table for determining a battery voltage-dependent coefficient KVB used in calculating the recharging duration T2;

FIG. 10 (*b*) schematically shows the construction of a conventional distributor;

DETAILED DESCRIPTION

The invention will now be described in detail with reference to the drawings showing embodiments thereof.

Figure 1:
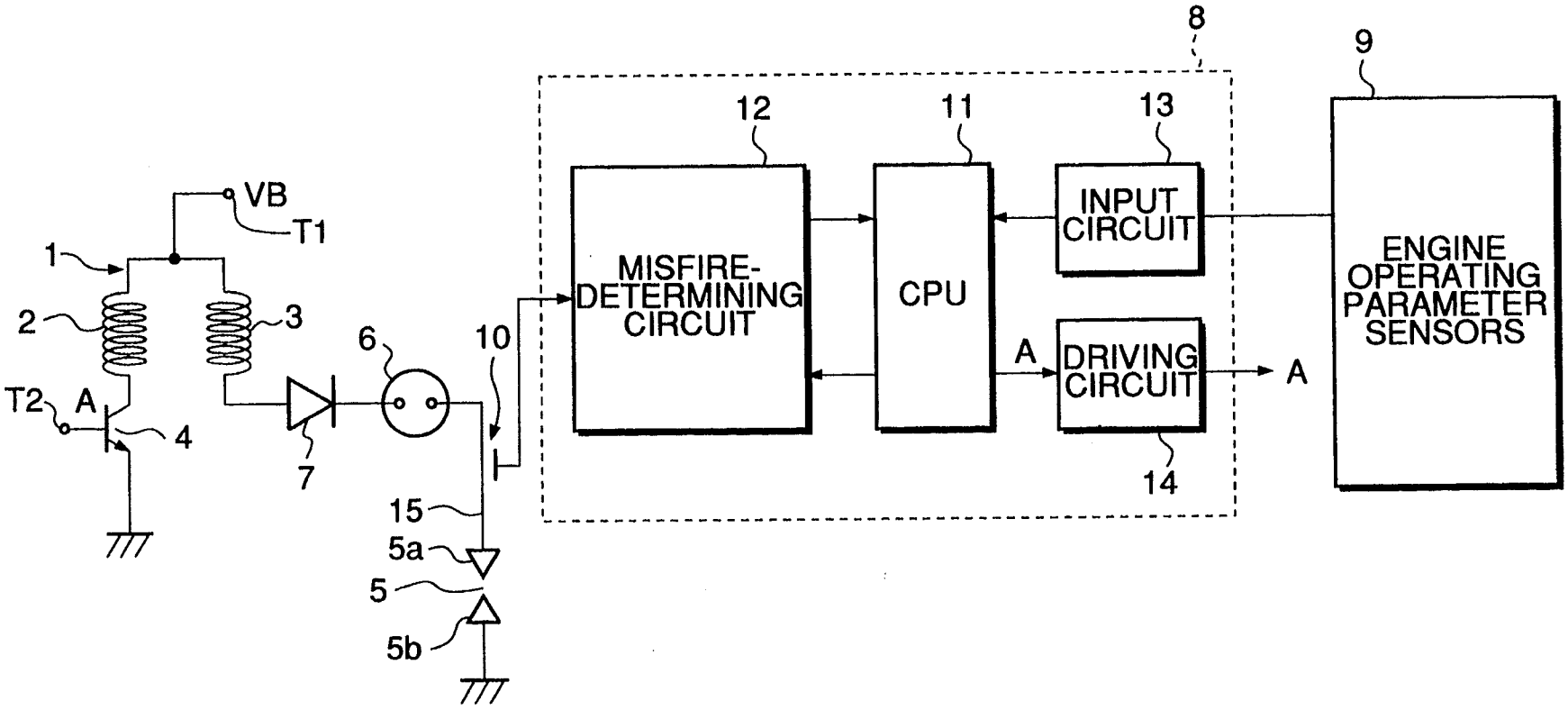
FIG. 1 is a block diagram showing the whole arrangement of a misfire-detecting system therefor, according to an embodiment of the invention.

Referring first to FIG. 1, there is shown the arrangement of a misfire-detecting system according to a first embodiment of the invention, which is incorporated in an internal combustion engine. A feeding terminal T1, which is supplied with supply voltage VB for the ignition device 16 from a battery, not shown, is connected to an ignition coil 1 comprised of a primary coil 2 and a secondary coil 3, which is provided in each of cylinders of the engine which is a four cylinder type, for example. The primary and secondary coils 2, 3 are connected with each other at ends thereof. The other end of the primary coil 2 is connected to a collector of a transistor 4. The transistor 4 has its base connected an input terminal T2 through which is supplied an ignition command signal A from an electronic control unit (hereinafter referred to as "the ECU") 8, to be supplied with the ignition command signal A. The other end of the secondary coil 3 is connected to an anode of a diode 7, which in turn has its cathode connected via a distributor 6 to a center electrode 5*a* of each spark plug 5. The spark plug 5 has its grounding electrode 5*b* grounded.

A sparking voltage sensor 10 is provided at an intermediate portion of a connecting line 15 which connects between the distributor 6 and the center electrode 5*a*. The sensor 10 is electrostatically coupled to the connecting line 15 and forms together therewith a capacitance of several pF's, and its output is connected to a misfire-determining circuit 12 of the ECU 8. The misfire-determining circuit 12 is connected to a central processing unit (hereinafter referred to as "the CPU") 11 to supply results of its determination of a misfire thereto. The CPU 11 carries out timing control related to the misfire determination.

Connected to the CPU 11 are various operating parameter sensors, generically designated by reference numeral 9, which sense various operating parameters of the engine including engine rotational speed NE and supply sensed values of the operating parameters to the CPU 11 via an input circuit 13. The CPU 11 is connected to the base of the transistor 4 via a driving circuit 14 to supply an energization control signal A to the transistor 4.

Figure 2:
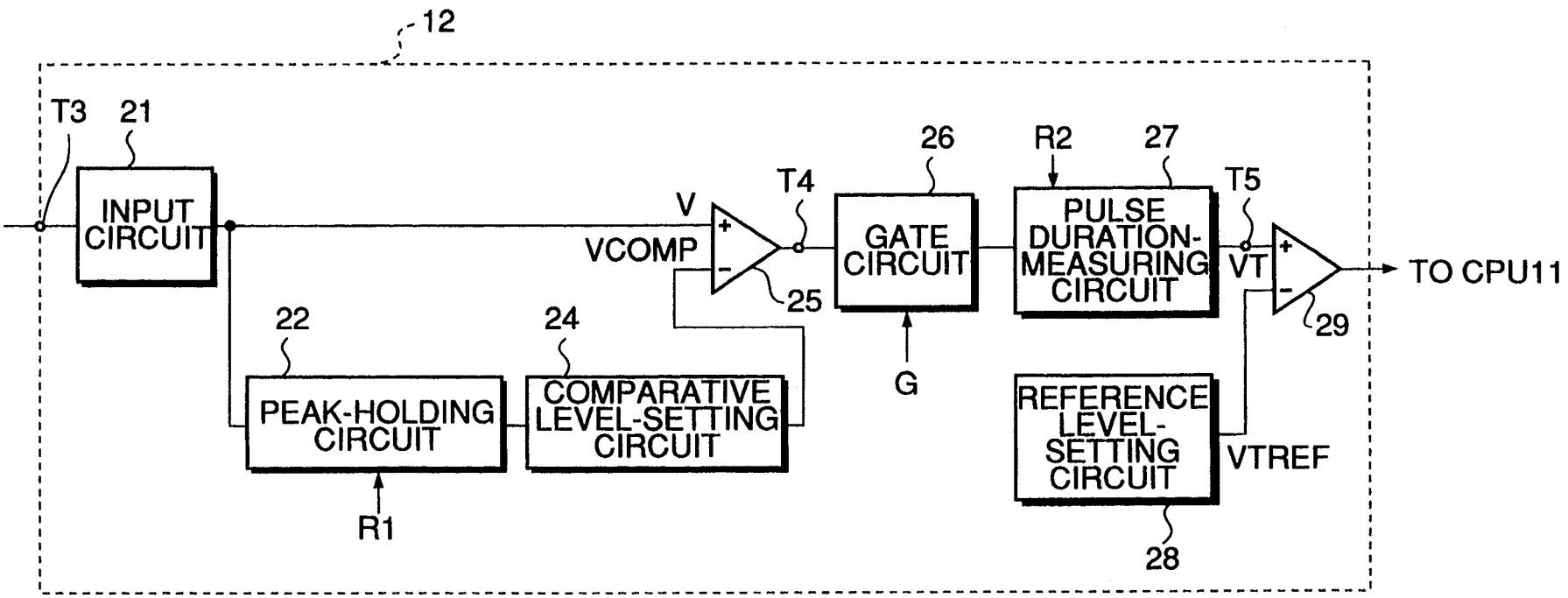
FIG. 2 is a circuit diagram showing details of a misfire-determining circuit appearing in FIG. 1.

FIG. 2 shows details of the misfire-determining circuit 12. An input terminal T3 thereof is connected via an input circuit 21 to a non-inverting input terminal of a first comparator 25, as well as to an input of a peak-holding circuit 22. The output of the peak-holding circuit 22 is connected via a comparative level-setting circuit 24 to an inverting input terminal of the first comparator 25. The peak-holding circuit 22 is supplied with a resetting signal R1 from the CPU 11 for resetting at an appropriate time a peak value of the sparking voltage held by the peak-holding circuit 22.

An output from the first comparator 25 is supplied to a pulse duration-measuring circuit 27 via a gate circuit 26. The pulse duration-measuring circuit 27 measures a time duration during which an output from the first comparator 25 assumes a high level, within a gating time during which the gate circuit 26 permits an input thereto to be outputted as it is, and the circuit 27 supplies an output voltage VT corresponding to the measured time duration to a non-inverting input terminal of a second comparator 29. A reference level-setting circuit 38 is connected to an inverting input terminal of the second comparator 29 to supply the same with a reference voltage VTREF for misfire determination. When VT>VTREF stands, the second comparator 29 generates a high level output indicating that a misfire such as an FI misfire attributable to the fuel supply system of the engine. The misfire-determining circuit 12 is designed such that the reference voltage VTREF of the reference level-setting circuit 28 can be varied by a command from the CPU 11, in response to engine operating parameters including engine rotational speed and absolute pressure within an intake pipe of the engine. The CPU 11 also supplies the gate circuit 26 and the pulse duration-measuring circuit 27 with a gating signal G which determines the gating time and a resetting signal R2 which determines the timing of resetting the pulse duration-measuring circuit 27, respectively.

Figure 3:
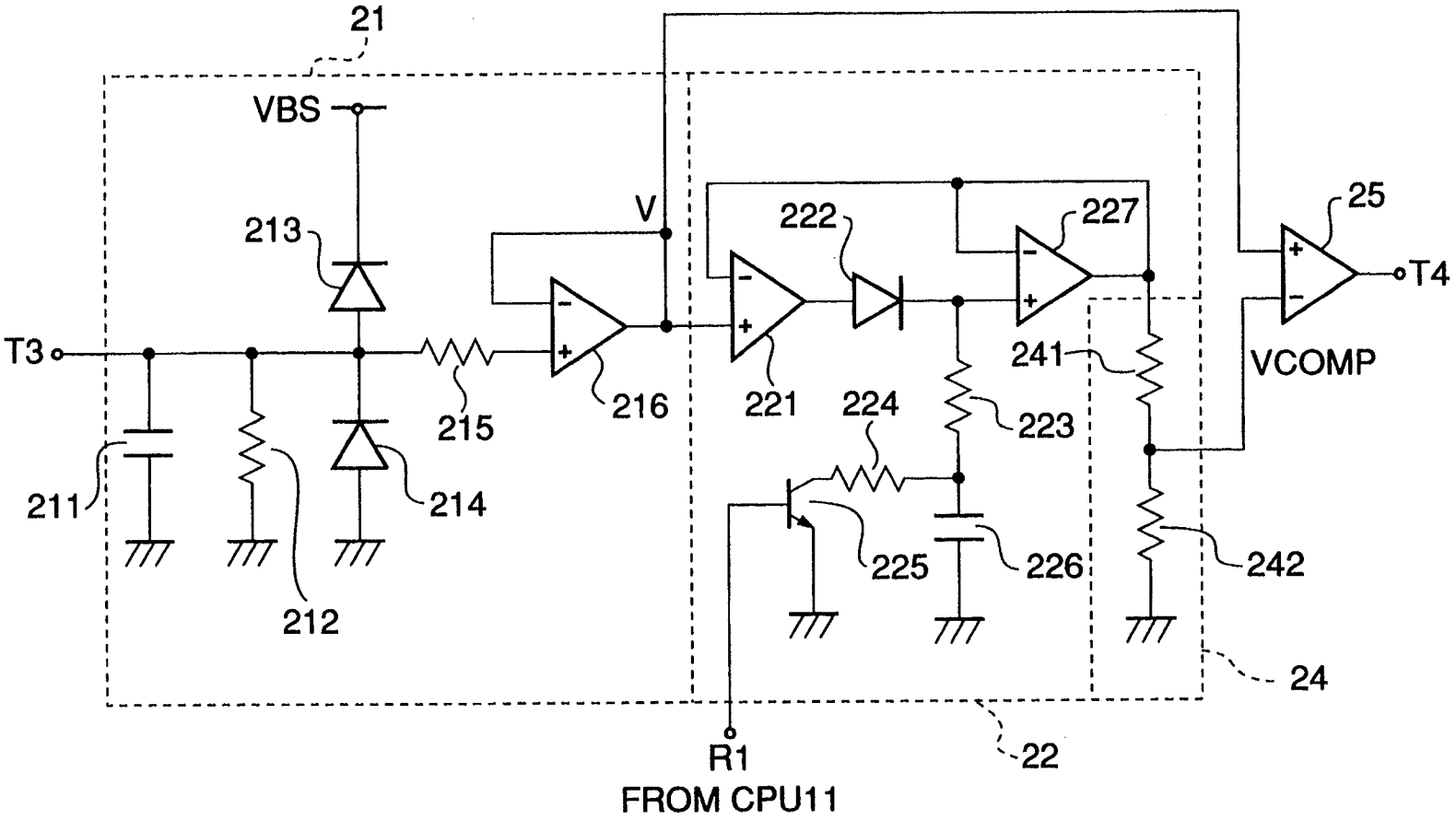
FIG. 3 is a circuit diagram showing details of parts of the misfire-determining circuit.

FIG. 3 shows details of the input circuit 21, the peak-holding circuit 22 and the comparative level-setting circuit 24 in FIG. 2. As shown in the figure, an input terminal T3 is connected to a non-inverting input terminal of an operational amplifier 216 via a resistance 215. The input terminal T3 is grounded via a circuit formed of a capacitor 211, a resistance 212, and a diode 214, which are connected in parallel, and connected to a supply voltage-feeding line VBS via a diode 213.

The capacitor 211 has a capacitance of $10^4$ pF, for example, and serves to divide voltage detected by the sparking voltage sensor 13 into one over several thousands. The resistance 212 has a value of 500 KΩ, for example. The diodes 213 and 214 act to control the input voltage to the operational amplifier 216 to a range of 0 to VBS. An inverting input terminal of the operational amplifier 216 is connected to the output of the same so that the operational amplifier 216 operates as a buffer amplifier (impedance converter).

The output of the operational amplifier 216 is connected to the non-inverting input terminal of the first comparator 15 as well as an inverting input terminal of an operational amplifier 221. The output of the operational amplifier 221 is connected to a non-inverting input terminal of an operational amplifier 227 via a diode 222, with inverting input terminals of the amplifiers 221, 227 both connected to the output of the amplifier 227. Therefore, these operational amplifiers form a buffer amplifier.

The non-inverting input terminal of the operational amplifier 227 is grounded via a resistance 223 and a capacitor 226, the junction therebetween being connected to a collector of a transistor 225 via a resistance 224. The transistor 225 has its emitter grounded and its base supplied with the resetting signal R1 from the CPU 11. The resetting signal R1 goes high when resetting is to be made.

The output of the operational amplifier 227 is grounded via resistances 241 and 242 forming the comparative level-setting circuit 24, the junction between the resistances 241, 242 being connected to the inverting input terminal of the comparator 25.

The circuit of FIG. 3 operates as follows: A peak value of the detected sparking voltage V (output from the operational amplifier 216) is held by the peak-holding circuit 22, the held peak value is multiplied by a predetermined value smaller than 1 by the comparative level-setting circuit 24, and the resulting product is applied to the first comparator 25 as the comparative level VCOMP. Thus, a pulse signal indicative of the comparison result, which goes high when V>VCOMP stands, is outputted from the first comparator 25 through a terminal T4.

Figure 4:
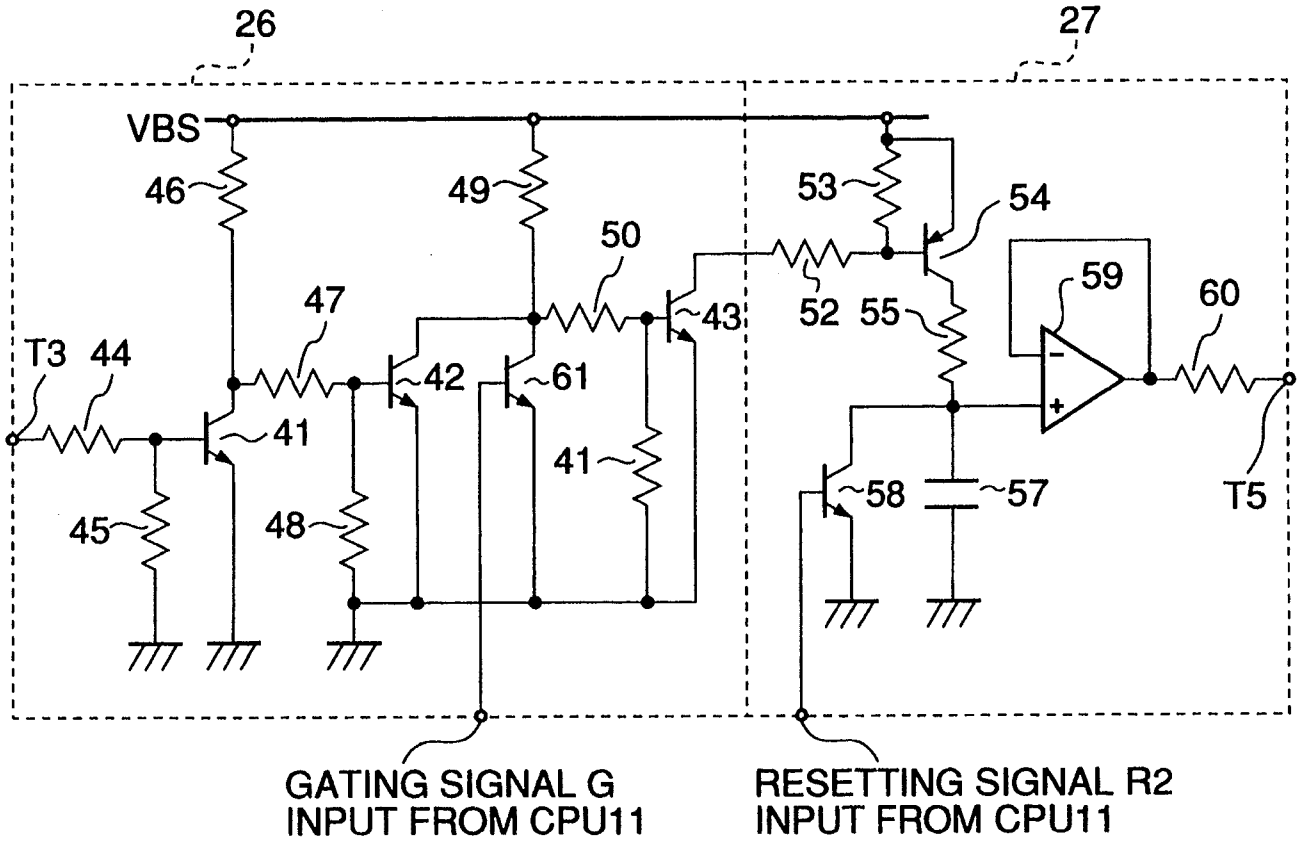
FIG. 4 is a circuit diagram showing details of other parts of the misfire-determining circuit.

FIG. 4 shows details of the construction of the gate circuit 26 and the pulse duration-measuring circuit 27. A three-stage invertor circuit is formed by transistors 41–43 and resistances 44–51. Connected between a collector of the transistor 42 and ground is a transistor 61 with a base thereof disposed to be supplied with the gating signal G from the CPU 11. Therefore, during the gating time during which the gating signal G assumes a low level, the collector of the transistor 43 goes low or high as the potential at the terminal T4 goes high or low, whereas when the gating signal G assumes a high level, the collector of the transistor 43 remains at a high level irrespective of the potential at the terminal T4. The collector of the transistor 43 is connected to a base of a transistor 54 via a resistance 52, which has its base connected to the supply voltage-feeding line VBS via a resistance 53, its emitter directly connected to the line VBS, and its collector grounded via a resistance 55 and a capacitor 57. The junction between the resistance 55 and the capacitor 57 is connected to a terminal T5 via an operational amplifier 59 and a resistance 60. The operational amplifier 59 serves as a buffer amplifier. The junction between the resistance 55 and the capacitor 57 is connected via a resistance 56 to a collector of a transistor 58 which has its emitter grounded and its base disposed to be supplied with the resetting signal R2 from the CPU 11.

The circuit of FIG. 4 operates as follows: When the potential at the terminal T4 goes high while the gating signal G is at a low level, the potential at the collector of the transistor 43 goes low so that the transistor 54 turns on to cause charging of the capacitor 57. On the other hand, when the potential at the terminal T4 goes low or when the gating signal G goes high, the transistor turns off to stop charging of the capacitor 57. Therefore, the terminal T5 is supplied with a voltage VT having a value corresponding to the time period during which the pulse signal inputted through the terminal T4 assumes a high level.

Figures 5A, 5B, 5C, 5D, 5E, 5F, 5G, 5H, 5I:
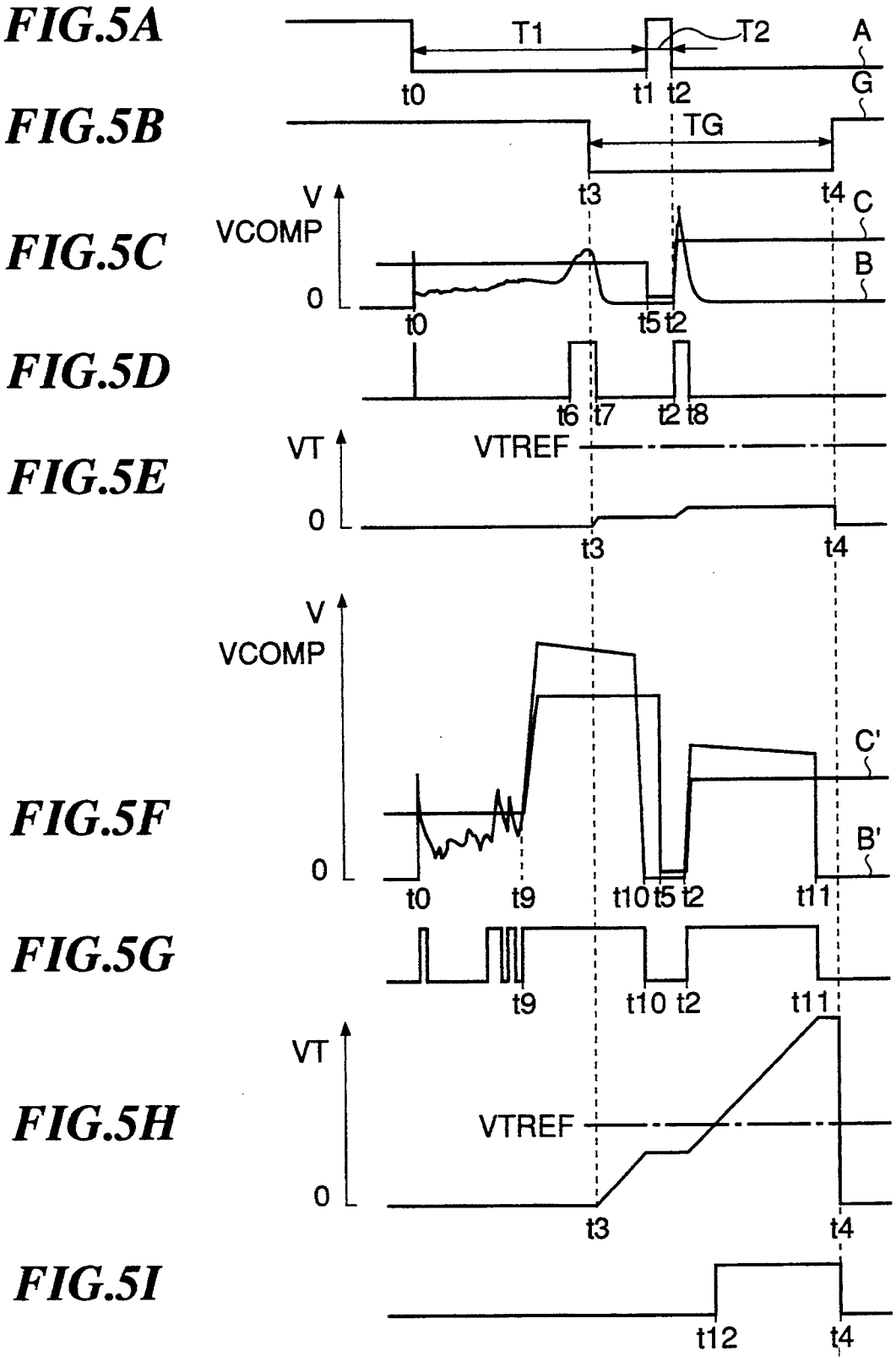

The operation of the misfire-detecting system constructed as above according to this embodiment will now be explained with reference to a timing chart formed of FIG. 5 (*a*) to FIG. 5 (*i*). FIGS. 5 (*a*) and (*b*) show the energization control signal A and the gating signal G, respectively. FIG. 5 (*c*) to FIG. 5 (*e*) show operation at normal firing, while FIG. 5 (*f*) to FIG. 5 (*i*) show operation at a misfire attributable to the fuel supply system (hereinafter referred to as "FI misfire").

As shown in FIG. 5 (*a*), according to the present embodiment, after the ignition command signal is generated at a time point t0, i.e. after the supply of current to the primary coil 2 is cut off after the coil 2 have been energized for a time period required for causing spark ignition, the coil 2 is again energized from a time point t1 to a time point t2 (hereinafter referred to as "reenergization"). This reenergization is carried out in such a manner that a voltage is applied between the electrodes of the spark plug 5 at the time point t2, which has such a low predetermined value as does not cause discharge between the electrodes, whereby electric charge is stored in floating capacitance between the spark plug 5 and its peripheral circuit parts. The voltage applied to the spark plug 5 at the time point t2 will be hereinafter referred to as the recharging voltage.

FIGS. 5 (*b*) and 5 (*f*) show changes in the detected sparking voltage (output voltage from the output circuit 21) V (B, B') and changes in the comparative level (C, C') with the lapse of time. First, a sparking voltage characteristic obtainable in the case of normal firing will be explained with reference to FIG. 5 (*b*).

Immediately after the time point t0 the ignition command signal A is generated, sparking voltage V rises to such a level as to cause dielectric breakdown of the mixture between the electrodes of the spark plug, i.e. across the discharging gap of the spark plug. After occurrence of the dielectric breakdown, the discharge state shifts from a capacitive discharge state before the dielectric breakdown (early-stage capacitive discharge), which state has a very short duration with several hundreds amperes of current flow, to an inductive discharge state which has a duration of several milliseconds and where the sparking voltage assumes almost a constant value with several tens milliamperes of current flow. The inductive discharge voltage rises with an increase in the pressure within the engine cylinder caused by the compression stroke of the piston executed after the time point t0, since a higher voltage is required for inductive discharge to occur as the cylinder pressure increases. At the final stage of the inductive discharge, the voltage between the electrodes of the spark plug lowers below a value required for the inductive discharge to continue, due to decreased inductive energy of the ignition coil so that the inductive discharge ceases and again capacitive discharge (late-stage capacitive discharge) occurs. In this capacitive discharge state, the voltage between the spark plug electrodes again rises, i.e. in the direction of causing dielectric breakdown of the mixture. However, since the ignition coil 1 then has a small amount of residual energy, the amount of rise of the voltage is small. This is because the electrical resistance of the discharging gap is low due to ionizing of the mixture during firing.

In this connection, at normal firing, the charge stored in the floating capacitance between the diode 7 and the spark plug (i.e. residual charge left after the discharge) is not discharged toward the ignition coil 1 due to the presence of the diode 7, but neutralized by ions present in the vicinity of the electrodes of the spark plug 5, so that the sparking voltage V promptly declines after the termination of the capacitive discharge.

Thereafter, when the recharging voltage is applied to the spark plug at the time point t2, the sparking voltage V again rises. The electric charge charged into the floating capacitance by the application of the recharging voltage is neutralized by ions present in the vicinity of the electrodes of the spark plug 5 to promptly decline, similarly to the state immediately after termination of the late-stage capacitive discharge.

The comparative level VCOMP obtained from the peak held value of the sparking voltage V assumes, until a time point t5, a value corresponding to a peak-held value of sparking voltage V obtained after resetting of the peak-holding circuit 22 on the last occasion, in the illustrated example. When the peak-holding circuit 22 is reset at the time point t5 by the resetting signal R1, the comparative level VCOMP is held at a predetermined low level (>0 volts) until the time point t2, whereupon the predetermined low level or reset state is canceled (hereinafter, the timing of canceling the predetermined low level state will be referred to as "the resetting (initialization) timing"). Therefore, after the time point t2 the comparative level VCOMP shows a value dependent on a peak value of the sparking voltage V caused by the recharging voltage after the peak-holding circuit 22 was reset at the time point t5. In the present embodiment, the comparative level VCOMP is set to approximately two thirds of the peak value. As a result, the output from the first comparator 25 which compares between the sparking voltage V and the comparative level VCOMP assumes a high level at or about the time point t0, between time points t0 and t7, and between time points t2 and t8, as shown in FIG. 5 (*d*), whereas the output from the gate circuit 26 assumes a high level only between time points t3 and t7 and between time points t2 and t8, within the gating time TG during which the gating signal G is at a low level. Accordingly, the output VT from the pulse duration-measuring circuit 27 changes as shown in FIG. 5 (*e*), that is, it does not exceed the reference voltage VTREF, so that it is determined that the engine is in a normal firing state.

Next, a sparking voltage characteristic will be described, which is obtained when a FI misfire occurs, i.e. no firing occurs, due to supply of a lean mixture to the engine or cutting-off of the fuel supply to the engine caused by faulty operation of the fuel supply system, etc. In FIG. 5 (*f*), immediately after the time point t0 of generation of the ignition command signal A, the sparking voltage V (B') rises above a level causing dielectric breakdown of the mixture. In this case, the ratio of air in the mixture is greater than when the mixture supplied to the engine has an air-fuel ratio close to the stoichiometric ratio, and accordingly the dielectric strength of the mixture is high. Besides, since the mixture is not fired, it is not ionized so that the electrical resistance of the discharging gap of the spark plug is high. Consequently, the dielectric breakdown voltage becomes higher than that obtained in the case of normal firing of the mixture. Thereafter, the discharge state shifts to an inductive discharge state, as in the case of normal firing. However, the electrical resistance of the discharging gap of the spark plug at the discharge is greater in the case of supply of a lean mixture, etc. than that in the case of normal firing so that the inductive discharge state tends to shift to a capacitive discharge state earlier than in the case of normal firing. The capacitive discharge occurring after termination of the inductive discharge (late-stage capacitive discharge) is much higher than that at normal firing, because the voltage of dielectric breakdown of the mixture is higher than that at normal firing.

On this occasion, almost no ion is present in the vicinity of the electrodes of the spark plug 5 so that the charge stored between the diode 7 and the spark plug 5 is not neutralized, nor is it allowed to flow backward to the ignition coil 1 due to the presence of the diode 7. Therefore, the charge is held as it is without being discharged through the electrodes of the spark plug 5. Then, when the pressure within the engine cylinder lowers so that the voltage between the electrodes of the spark plug 5 required for discharge to occur becomes equal to the voltage applied by the charge, there occurs a discharge between the electrodes of the spark plug 5. As the sparking voltage V is higher, the discharge takes place earlier.

Thereafter, at the time point t2, the recharging voltage is applied to the spark plug 5. As a result, the sparking voltage V again rises. On this occasion, as mentioned above, there is almost no ion present between the electrodes of the spark plug and hence the charge stored between the diode 7 and the spark plug 5 is not neutralized, so that the sparking voltage V is held in a high voltage state due to the presence of the diode 7. As the pressure within the cylinder further lowers so that the voltage between the electrodes of the spark plug 5 required for discharge to occur becomes equal to the voltage applied by the charge, there occurs a discharge between the electrodes of the spark plug 5 (at a time point t11).

On the other hand, the comparative level VCOMP (C') assumes, until a time point t9, a value corresponding to a peak-held value of sparking voltage V obtained after resetting of the peak-holding circuit 22 on the last occasion, in the illustrated example. After the time point t9, the comparative level VCOMP rises with a rise in the sparking voltage V and thereafter is maintained at a value dependent upon a peak value of the sparking voltage V until the time point t5. When the peak-holding circuit 22 is reset at the time point t5 by the resetting signal R1, the comparative level VCOMP is held at a predetermined low level (>0 volts) until the time point t2. After the time point t2 the comparative level VCOMP is maintained at a value dependent on a peak value of the sparking voltage V caused by the application of the recharging voltage. As a result, the output from the first comparator 25 assumes a high level immediately before the time point t9, between time points t9 and t10, and between time points t2 and t11, as shown in FIG. 5 (*g*), whereas the output from the gate circuit 26 assumes a high level only during time periods when the output from the comparator 25 assumes a high level within the gating time TG. Accordingly, the output VT from the pulse duration-measuring circuit 27 changes as shown in FIG. 5 (*h*), that is, it exceeds the reference voltage VTREF at a time point t12, so that the output from the second comparator 29 assumes a high level between time points t12 and t4 as shown in FIG. 5 (*i*), resulting in a determination that an FI misfire has occurred.

As shown in FIG. 5 (*f*), in the case where the sparking voltage V rises to a relatively high level during the late-stage capacitive discharge, the sparking voltage V declines at an early time (at the time point t10), at which the output VT from the pulse duration-measuring circuit 27 does not yet exceed the reference voltage VTREF, resulting in failure to detect an FI misfire. To eliminate this inconvenience, according to the present embodiment, the recharging voltage is applied to the spark plug 5 at the time point t2, at a voltage value lower than a voltage value causing discharge between the electrodes of the spark plug. Therefore, even when the sparking voltage V assumes a high voltage value, an FI misfire can be detected without fail.

Further, according to the embodiment, the gating time TG during which the gate circuit 26 is open is provided over a predetermined time period (between time points t3 and t4) starting from a time point near the termination of the late-stage capacitive discharge (immediately before the termination of the inductive discharge). Since the terminating point of the late-stage capacitive discharge varies depending upon engine operating conditions including engine rotational speed and intake pipe absolute pressure, the starting point of the gating time TG is set depending upon values of these engine operating parameters. The terminating point of the gating time TG (at the time point t4) may be set to any time before a rotor head of the distributor 6 reaches the next segment, i.e. any time within a crank angle of 120 degrees from the spark ignition. Also the terminating point of the gating time TG may be set depending upon values of engine operating parameters including engine rotational speed and intake pipe absolute pressure.

In the illustrated example, the pulse duration-measuring circuit 27 is reset at the time point t4.

Further, in the illustrated example, the peak-holding circuit 22 is reset at the same time as the time point of application of the recharging voltage. This is because the sparking voltage V is unstable in level during the late-stage capacitive discharge and immediately thereafter, and therefore, if the circuit 22 is reset during the late-stage capacitive discharge or immediately thereafter, the resulting comparative level VCOMP will be unstable in level, making it impossible to carry out accurate misfire determination, and also because the intended result from the application of recharging voltage cannot be obtained if the resetting time is set to a time point much later than the time of generation of the recharging voltage. Therefore, the peak-holding circuit 22 should be reset at or about the time point of generation of the recharging voltage.

Next, the timing of application of the recharging voltage (hereinafter referred to as the recharging timing") will be explained:

If the recharging timing is set to a timing point earlier than the termination of discharge caused by the ignition command signal, there is a possibility that the time period over which the sparking voltage V exceeds the comparative level VCOMP becomes too long even at normal firing, or the sparking voltage V hardly exceeds the comparative level VCOMP even at a misfire, resulting in failure to achieve accurate misfire determination. On the other hand, if the recharging timing is set to too late a time point, it will result in a decrease in the amount of ions generated between the electrodes of the spark plug at normal firing, making it impossible to discriminate between normal firing and a misfire.

Therefore, the optimal results can be obtained if the recharging timing is set to a time point corresponding to a crank angle of approximately 10 degrees after the top dead center of the cylinder. If this timing setting is impossible, the recharging timing should be set to a time point earlier than a crank angle of 40 degrees after the top dead center at the latest.

Further, in the present embodiment, the recharging timing is set depending upon engine rotational speed and load on the engine, in view of the fact that the time duration of discharge caused by the ignition command signal varies in dependence on operating conditions of the engine, particularly engine rotational speed and load on the engine.

Figure 6:
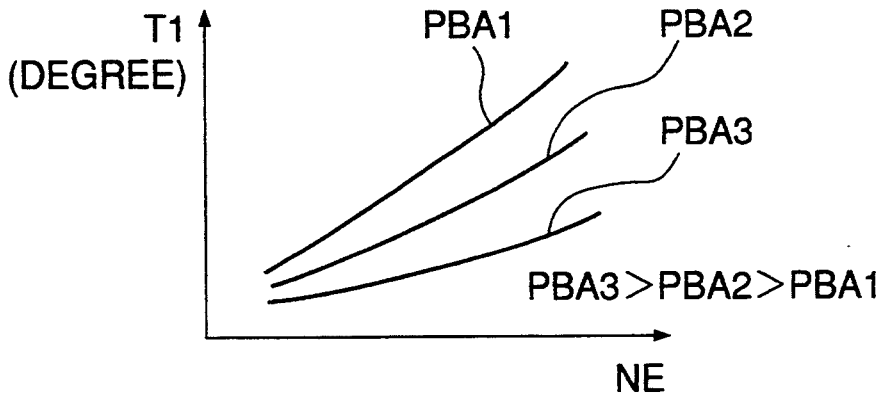
FIG. 6 shows a map for determining a time period T1 which determines recharging timing of the ignition coil.

More specifically, a timing value T1 for determining the recharging timing is read from a T1 map shown in FIG. 6, for example. According to the T1 map of FIG. 6, the T1 value is set in terms of the crank angle relative to the ignition timing (at the time point t0 in FIG. 5 (*a*)) and as a function of engine rotational speed NE and intake pipe absolute pressure PBA such that as the engine rotational speed NE is higher and/or as the intake pipe absolute pressure PBA is lower, the T1 value is set to a larger value.

This is based upon the following ground: In general, the ignition timing is set to a more advanced value as the engine rotational speed NE and/or as the intake pipe absolute pressure PBA is lower, whereas the best recharging timing should be a crank angle of approximately 10 degrees after the top dead center as mentioned above. Therefore, the recharging timing should be set to such a constant timing value (10 degrees after the top dead center) irrespective of the NE and PBA values.

In addition, the time duration of discharge caused by spark ignition and that of combustion should also be taken into account in determining the recharging timing, since these time durations tend to become shorter as the engine rotational speed NE is higher and/or as the intake pipe absolute pressure PBA is higher. The T1 map of FIG. 6 is set with this fact taken into account, as well.

As mentioned before, the value of the recharging voltage should be set to such a predetermined value as does not cause discharge between the electrodes of the spark plug. The recharging voltage is controlled to the predetermined value by varying the time period T2 over which the ignition coil 1 is again energized (see FIG. 5 (*a*)), since a change in the reenergization duration T2 causes a change in the energy stored in the ignition coil 1 and hence a change in the voltage generated upon cutting-off of the reenergization current (at the time point t2).

Figure 7:
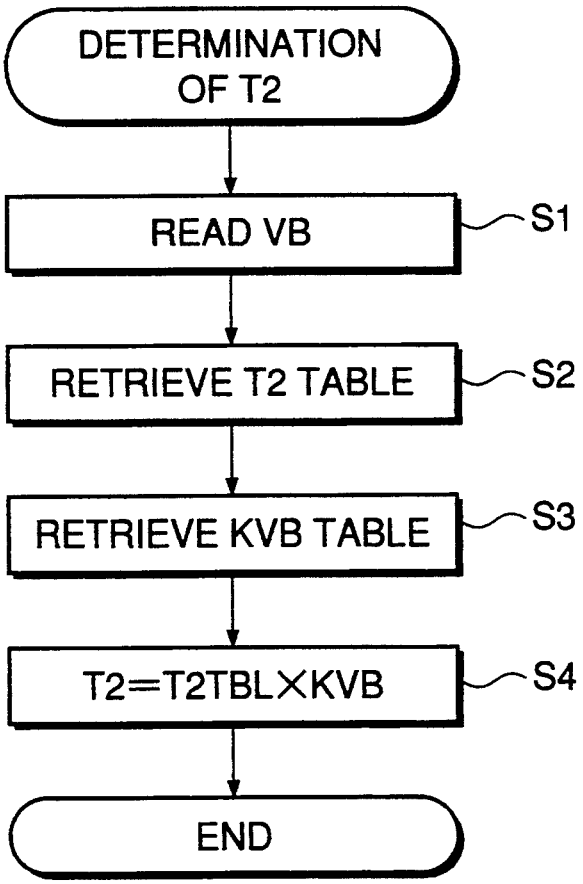
FIG. 7 is a flowchart showing a program for calculating a recharging duration T2.

The reenergization duration T2 is calculated in a manner shown in FIG. 7.

Figure 8A:
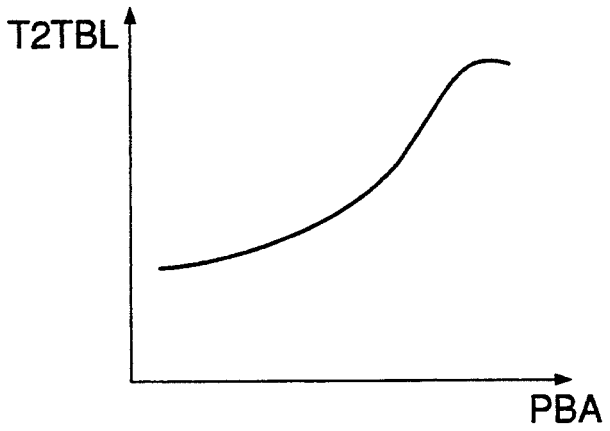
FIG. 8 (*a*) shows a table for determining an intake pipe absolute pressure-dependent value T2TBL used in calculating the recharging duration T2.
Figure 8B:
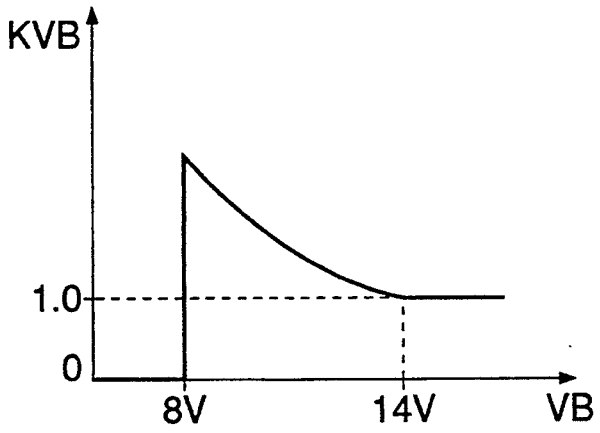

At a step S1 in the figure, a value of the battery voltage VB applied to the spark plug 5 is read, and then retrieval of a T2 table is carried out at a step S2. The T2 table has a table value T2TBL for determining the reenergization duration T2, which is set as a function of intake pipe absolute pressure PBA, as shown in FIG. 8 (*a*). According to the T2 table, as the intake pipe absolute pressure PBA is higher, the table value T2TBL is set to a larger value, since higher voltage is required for discharge to occur, as the PBA value is higher.

Then, at a step S3, retrieval of a KVB table is carried out in accordance with the battery voltage VB. The KVB table has a correction coefficient KVB set in accordance with the battery voltage VB, as shown in FIG. 8 (*b*). According to the KVB table, as the battery voltage VB is lower, the KVB value is see to a larger value.

At the next step S4, the reenergization duration T2 is calculated by the use of the following equation (1):

$$T2 = T2TBL \times KVB \quad (1)$$

By thus correcting the reenergization duration T2 in dependence on the battery voltage VB, it can be avoided that as the battery voltage VB lowers, the recharging voltage becomes lower for the same reenergization duration T2 so that no breakdown can occur across a series gap in the distributor 6. Further, as shown in FIG. 8 (*b*), when the VB value is lower than 8 volts, the KVB value is set to 0 to inhibit application of the recharging voltage and hence inhibit the misfire determination. Otherwise, if the battery voltage VB lowers below 8 volts, the reenergization duration T2 will be calculated to such a long time period as overlaps the time period of discharge caused by the spark ignition.

Thus, according to the embodiment, by setting the reenergization duration T2 in dependence on the intake pipe absolute pressure PBA and the battery voltage VB, a suitable recharging voltage value can be obtained.

The timing of starting the reenergization (at the time point t1 in FIG. 5 (*a*)) is set with reference to the timing of generation of the ignition command signal (at the time point t0 in FIG. 5 (*a*); see T1 in same), based upon the recharging timing (at the time point t2 in FIG. 5 (*a*)) and the reenergization duration T2.

Figure 9:
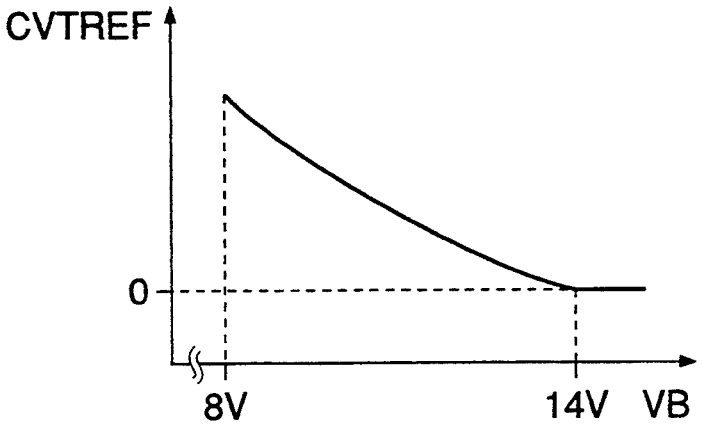
FIG. 9 shows a table for determining a correction variable CTVREF used in calculating a reference voltage value VTREF.

Alternatively of correcting the reenergization duration T2 in dependence on the battery voltage VB, the reference voltage VTREF to be compared with the output VT from the first comparator 25 may be calculated in dependence on the battery voltage VB by the use of the following equation (2):

$$VTREF = VTREF0 - CVTREF \quad (2)$$

where VTREF0 represents a value of the reference voltage VTREF assumed when the battery voltage VB is equal to 14 volts or higher, for example, and CTREF a correction variable set in accordance with the battery voltage VB, as shown in FIG. 9.

By thus correcting the VTREF value, as the battery voltage VB lowers, the VTREF value is changed to a lower value, assuring accurate misfire determination even with a drop in the battery voltage VB.

Figure 10A:
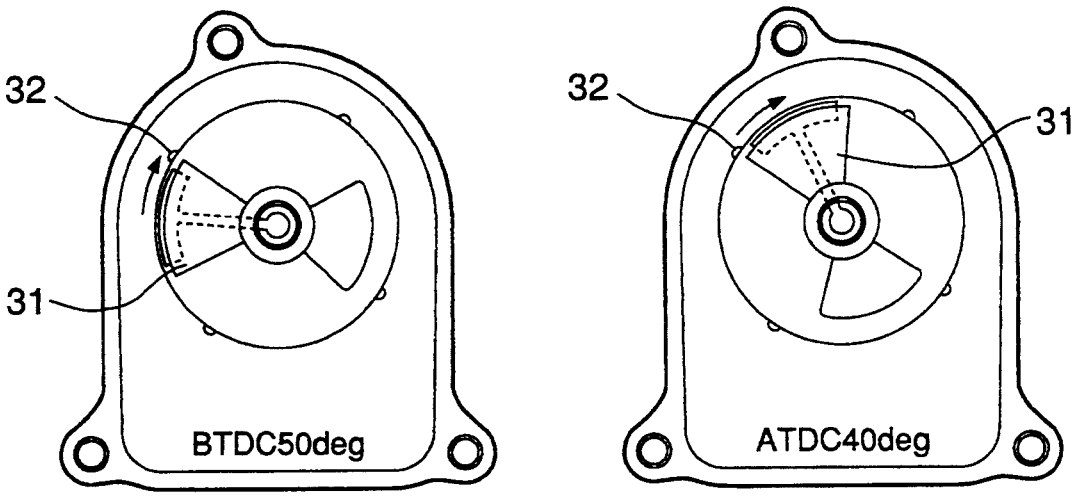
FIG. 10 (*a*) schematically shows the construction of a distributor according to the invention.
Figure 10B:
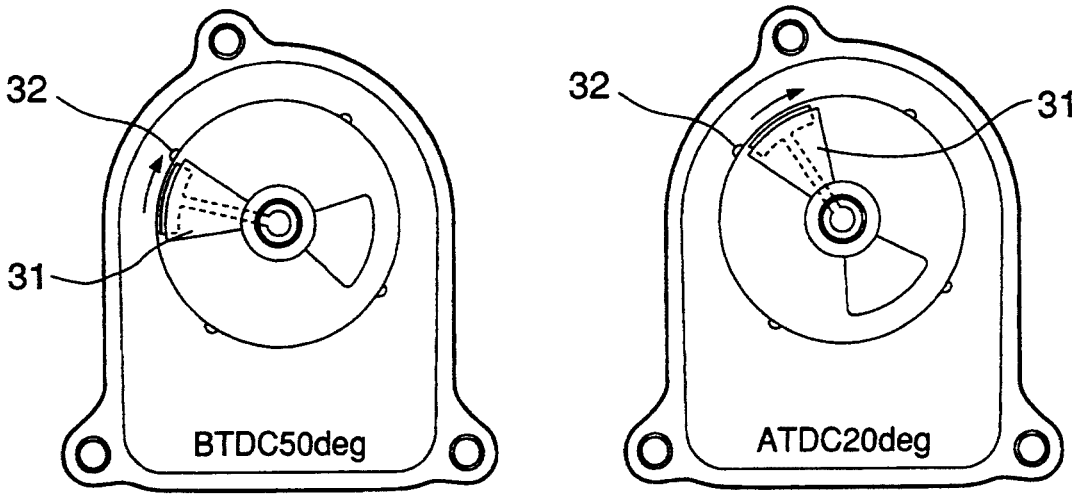

Next, the construction of the distributor 6 employed in the present embodiment will be described with reference to FIGS. 10 (*a*) and 10 (*b*). FIG. 10 (*a*) shows the construction of the distributor 6 used in the present embodiment, and FIG. 10 (*b*) the construction of a conventional distributor. A comparison between the two figures will show that the distributor according to the present embodiment has a rotor 31 which has a circumferential size, i.e. a size in a direction of rotation of the rotor 31 indicated by the arrow has a larger value as compared with that of the conventional distributor such that a crank angle over which the rotor 31 encounters each segment 32 (hereinafter referred to as "the rotor angle") ranges from 50 degrees before the top dead center (BTDC) to 40 degrees after the top dead center (ATDC). On the other hand, the rotor angle of the conventional distributor ranges from 50 degrees BTDC to 20 degrees ATDC. In other words, the rotor angle of the distributor of the present embodiment is extended toward the ignition timing retarded side.

By designing the distributor as described above, even if the recharging timing is set to the crank angle of 40 degrees ATDC, the recharging voltage can be positively applied between the electrodes of the spark plug. On the other hand, if the conventional distributor shown in FIG. 10 (*b*) is used, the recharging timing cannot be set to a value later than the crank angle of approximately 20 degrees ATDC. Consequently, the recharging voltage cannot be applied between the electrodes of the spark plug. Particularly, at a high engine rotational speed the timing of termination of discharge caused by the ignition command signal shifts toward the retarded side, and the recharging timing has to be set to the retarded side accordingly. However, the conventional distributor cannot be used in such a case, whereas the distributor according to the present invention enables positive application of the recharging voltage without fail.

The amount of extension of the rotor angle toward the retarded side has only to be such an amount as covers the crank angle of approximately 40 degrees ATDC, since the allowable most retarded value of the recharging timing is approximately 40 degrees ATDC. However, the time duration of discharge across the series gap of the distributor has to be taken into account in setting the retarded side limit of the recharging timing.

Figure 11:
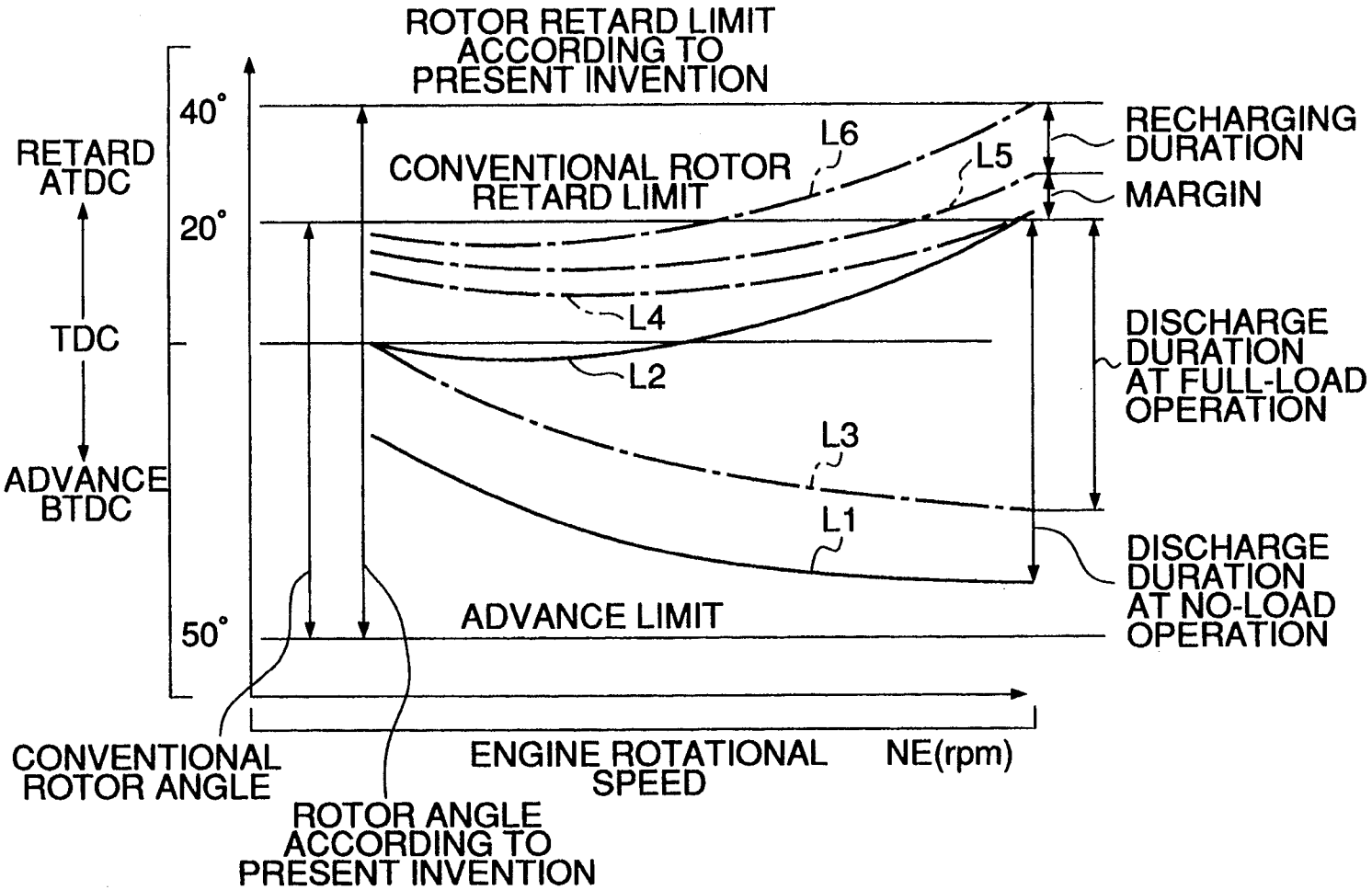
FIG. 11 is a graph useful in explaining the relationship between a rotor angle and the recharging timing.

FIG. 11 is a view useful in explaining the relationship between the rotor angle and the recharging timing. In the figure, the curves L1 and L2 represent ignition timing (timing of generation of the ignition command signal) and discharge termination timing which are assumed at no-load operation of the engine, respectively, and the curves L3 and L4 represent ignition timing and discharge termination timing which are assumed at full-load operation of the engine, respectively. Further, the curves L5 and L6 represent starting timing of reenergization of the ignition coil and termination timing of same, respectively, i.e. recharging timing. As shown in the figure, when the engine is in a high rotational speed region, the discharge termination timing shifts toward the retarded side irrespective of load on the engine, and therefore the recharging timing has to be retarded accordingly. By the use of the distributor according to the invention, positive application of the recharging voltage is made possible even in such a high rotational speed region.

Figure 12:
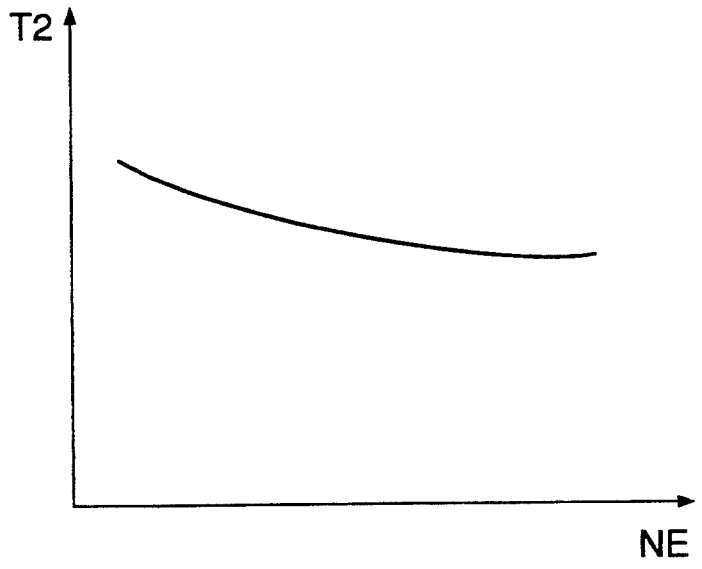
FIG. 12 shows the relationship between engine rotational speed NE and the recharging duration T2.

In addition, in the case of a distributor which cannot be designed to have such an increased rotor angle for some reason, the recharging timing can be set to a value later than the retard limit of the rotor angle. In such a case, the reenergization duration T2 has to be set to a larger value than values obtained from the table of FIG. 8 (*a*), referred to before, so that such a high recharging voltage is generated as causes breakdown between the rotor and the segment. In this case, as shown in FIG. 12, the reenergization duration T2 should desirably be set to a longer time period as the engine rotational speed NE decreases. because particularly when the engine is in a high load condition, the timing of generation of the ignition command signal is corrected to the retarded side by a larger amount as the engine rotational speed NE is lower.

Figures 13A, 13B, 13C, 13D, 13E, 13F, 13G, 13H, 13I:
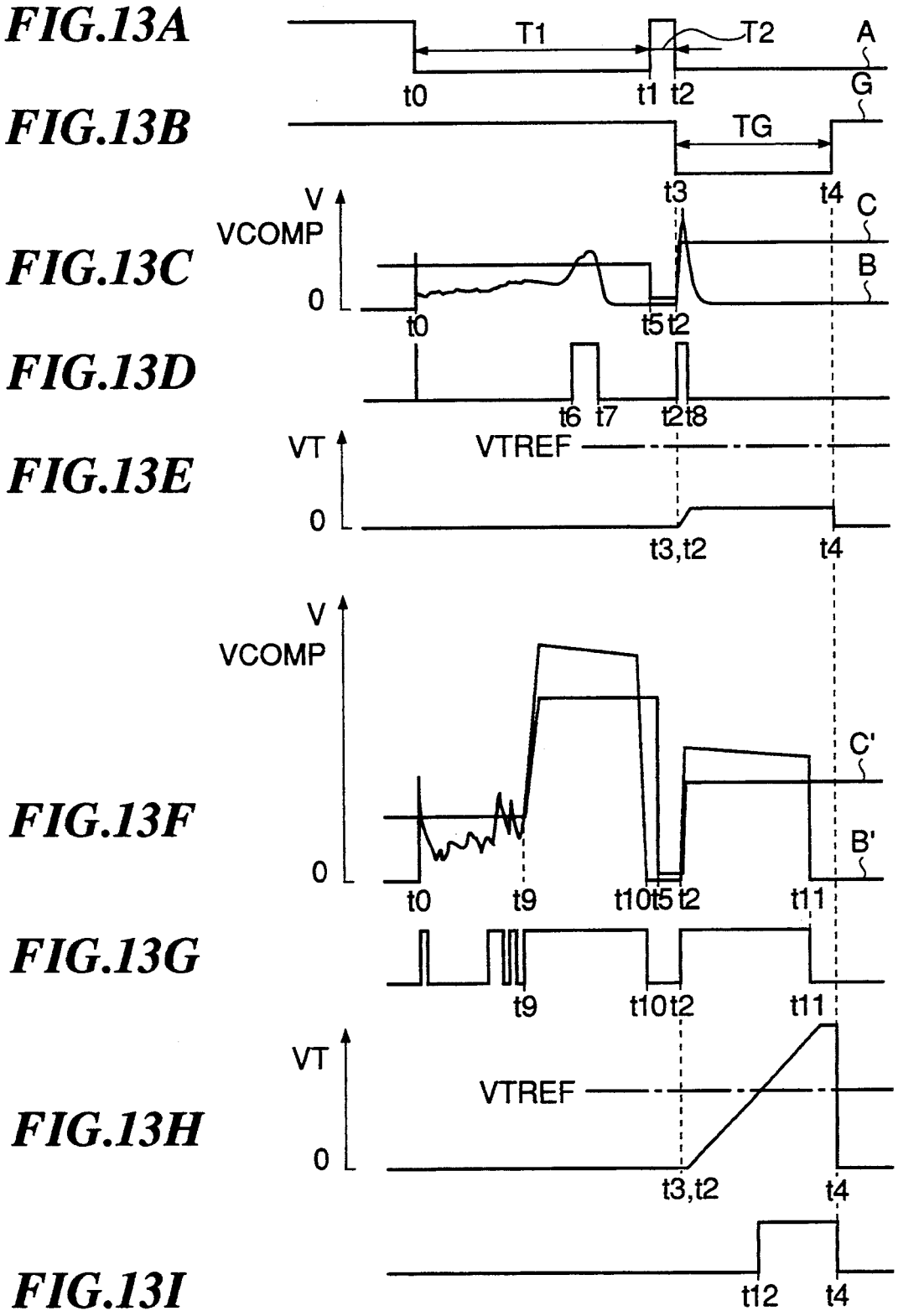
FIGS. 13 (*a*)–(*i*) are similar views to FIGS. 5 (*a*)–(*i*), according to a variation of the invention.

Next, variations of the misfire-detecting manner of the invention described above will be described with reference to FIGS. 13 (*a*)–(*i*) and FIGS. 14 (*a*)–(*i*):

According to the variation shown in FIGS. 13 (*a*)–(*i*), the starting timing of the gating time TG is set to a time point immediately after the recharging timing (time point t2). Except for this, this variation is identical with the above described embodiment. That is, FIGS. 13 (*a*), (*c*), (*d*), (*f*), and (*g*) are identical with FIGS. (*a*), (*c*), (*d*), (*f*), and (*g*). As is clear from FIGS. 13 (*e*) and 13 (*h*), also in this variation, the VT value exceeds the reference value VTREF only at a misfire, thus enabling to detect a misfire.

Figures 14A, 14B, 14C, 14D, 14E, 14F, 14G, 14H, 14I:
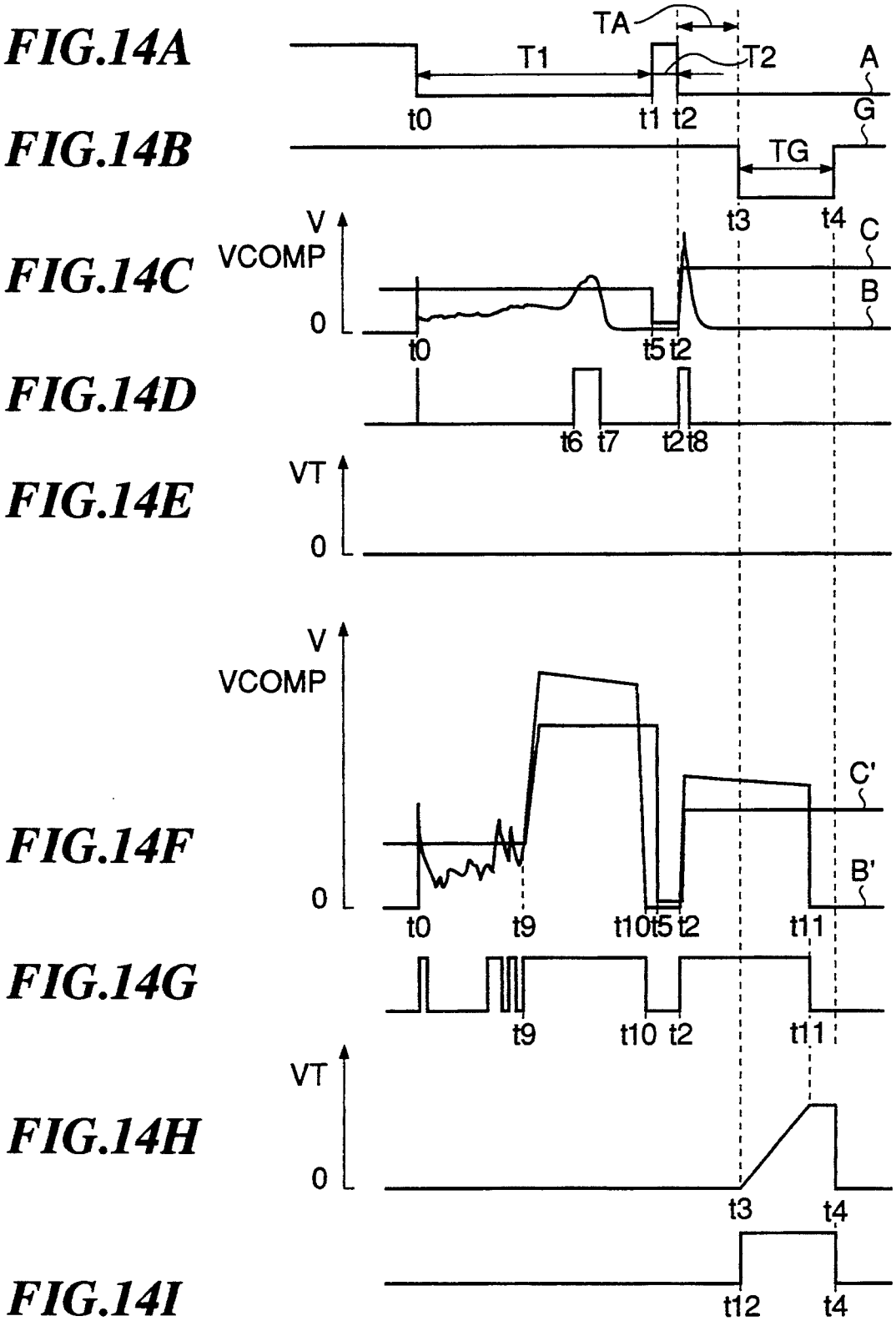
FIGS. 14 (*a*)–(*i*) are similar views to FIGS. 5 (*a*)–(*i*), according to a further variation of the invention.

According to the variation of FIGS. 14 (*a*)–(*i*), the starting timing of the gating time TG is set to a time point t3 upon the lapse of a predetermined time period TA after the recharging timing (time point t2). Except for this, this variation is identical with the above described embodiment. That is, FIGS. 14 (*a*), (*c*), (*d*), (*f*) and (*g*) are identical with FIGS. 5 (*a*), (*c*), (*d*), (*f*), and (*g*).

According to this variation, immediately when the sparking voltage V exceeds the comparative level VCOMP within the gating time TG, i.e. immediately when the output from the gate circuit 26 in FIG. 2 goes high, it is determined that a misfire has occurred. The predetermined time period TA is set to a time period longer than a time period within which the sparking voltage V caused by the recharging voltage positively declines at normal firing (see FIG. 14 (*c*)), so that the sparking voltage V never exceeds the comparative level VCOMP during the gating time TG at normal firing (see FIG. 14 (*c*)), whereas V > VCOMP stands between the gating starting time point. (t3) and a time point t11 when a misfire has occurred (see FIG. 14 (*g*)), thus enabling to detect a misfire without fail. In this variation, the predetermined time period TA is set in dependence on values of engine operating parameters including engine rotational speed and intake pipe absolute pressure.

According to this variation, the pulse duration-measuring circuit 27, the reference level-setting circuit 28, and the second comparator 29 can be omitted to thereby simplify the circuit arrangement.

Even in this variation wherein the gating time TG is started when the predetermined time period TA elapses from the recharging time point (time point t3), the output VT from the pulse duration-measuring circuit 27 changes as shown in FIG. 14 (*h*). Therefore, like the aforedescribed misfire-determining manner, it may be determined that a misfire has occurred when the VT value exceeds the reference value VTREF. FIG. 14 (*i*) shows an output from the second comparator 29 which is obtained when the VTREF value is set to a value slightly larger than 0.

In determining an FI misfire by utilizing the fact that the charge stored in the spark plug and its peripheral circuit parts shows different values between at an FI misfire and at normal firing as in the above described embodiment and its variations, the polarity of voltage applied to the spark plug 5 should desirably be set such that the potential on the center electrode 5*a* side is positive, because if the potential of the center electrode side is positive, the charge charged into the peripheral circuit parts of the spark plug electrodes becomes positive, which is neutralized by the negative charge, i.e. electrons, at normal firing. Since the moving velocity of electrons is higher than that of the positive charge, i.e. ions, the difference in the time period over which the sparking voltage V exceeds the comparative level VCOMP becomes larger between at normal firing and at a misfire.

A further embodiment of the invention will now be described with reference to FIGS. 15 (*a*)–(*e*) and FIGS. 16 (*a*)–(*e*).

Figures 15A, 15B, 15C, 15D, 15E:
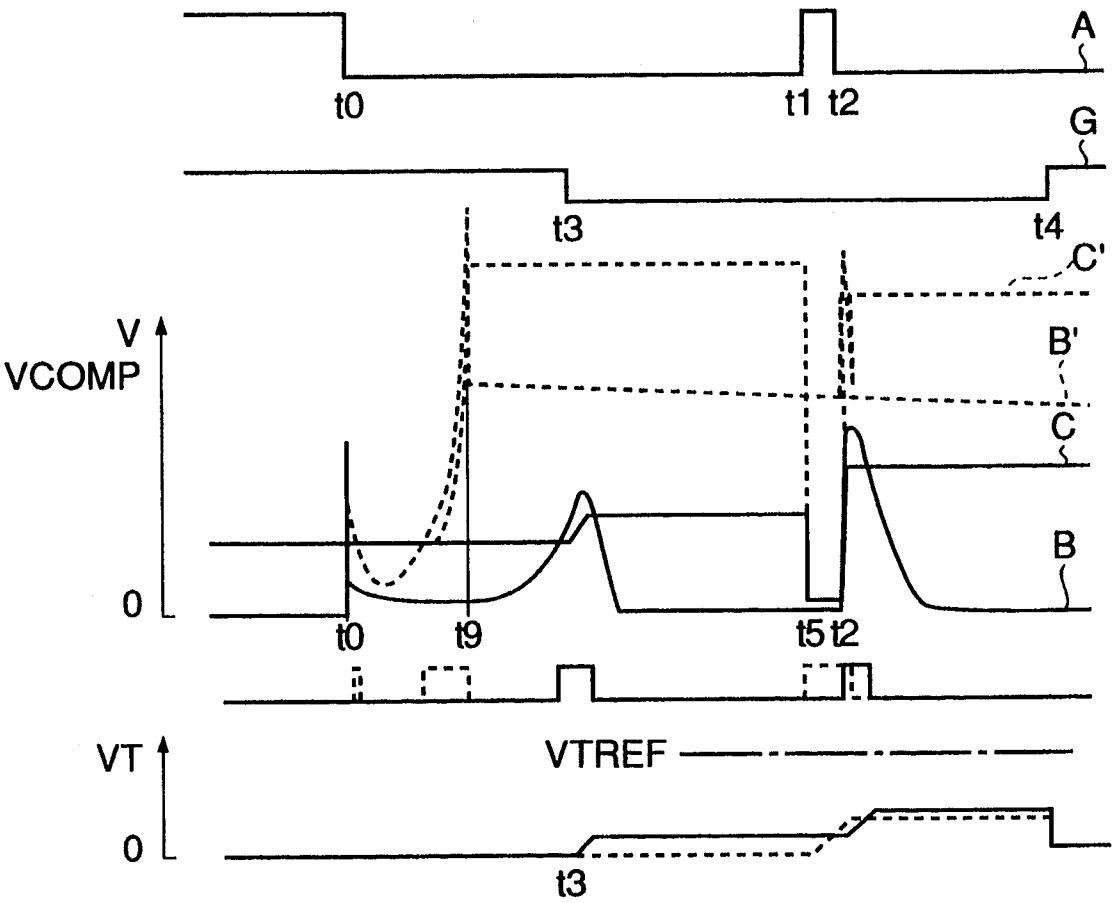
FIGS. 15 (*a*)–(*e*) are similar views to FIGS. 5 (*a*)–(*e*), useful in explaining sparking characteristics in the case where the insulation resistance lowers due to adhesion of carbon or the like to electrodes to a spark plug.

FIGS. 15 (*a*)–(*e*) show operation of the misfire-detecting system shown in FIGS. 1 to 5 (*a*)–(*i*), which is performed when carbon or the like adheres to the electrodes of the spark plug and hence the insulation resistance between the electrodes has become degraded. In FIGS. 15 (*c*)–(*e*), the solid lines snow a characteristic obtained at normal firing, and the broken lines a characteristic obtained at a misfire. As is clear from these figures, at normal firing the characteristic is almost identical with that shown in FIGS. 5 (*c*)–(*e*), while at an FI misfire when the sparking voltage V rises during the late-stage capacitive discharge, discharge takes place via the carbon or the like adhering to the electrodes, and then the sparking voltage V immediately declines (at a time point t9). Thereafter, a similar change takes place in the sparking voltage V also upon generation of the recharging voltage at a time point t2. Consequently, the comparative level VCOMP (C') assumes a value dependent upon a peak value of the sparking voltage V at the time point t9 or t2. Therefore, there is almost no time period over which the sparking voltage V exceeds the comparative level VCOMP. As a result, as shown in FIG. 15 (*d*), the time period over which the output from the first comparator 25 assumes a high level within the gating time TG is almost as long as the time period obtained at normal firing, thus failing to detect a misfire.

Figures 16A, 16B, 16C, 16D, 16E:
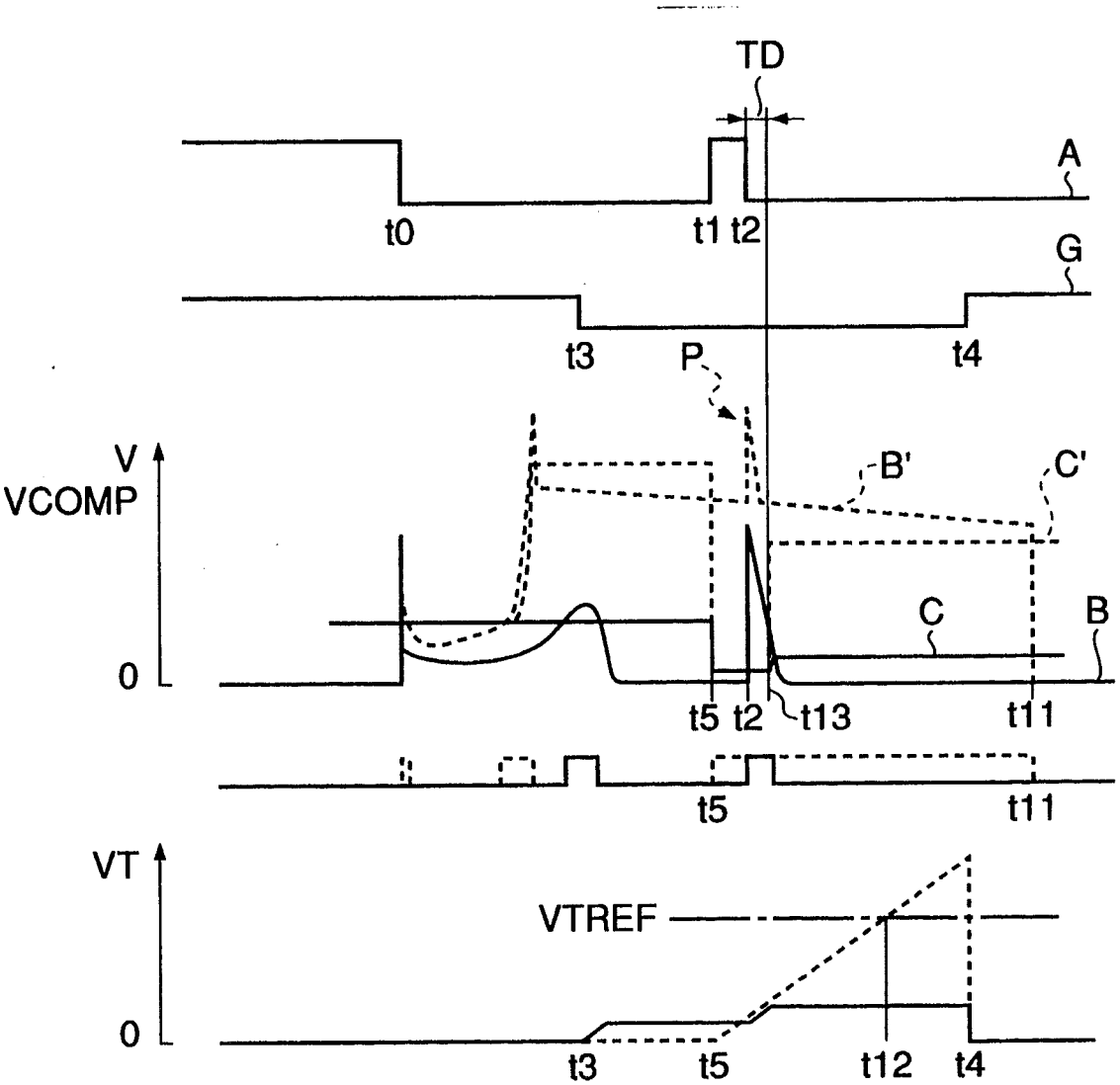
FIGS. 16 (*a*)–(*e*) are similar views to FIGS. 5 (*a*)–(*e*), according to a further embodiment of the invention.

To eliminate the above-mentioned disadvantage, according to this embodiment, as shown in FIGS. 16 (*a*)–(*e*), the timing of resetting the peak-holding circuit 22 is set to a time point (t13) upon the lapse of a predetermined time period TD after the time point of generation of the recharging voltage (t2). By thus setting the resetting timing of the peak-holding circuit 22, the comparative level VCOMP changes as indicated by the curve C' in FIG. 16 (*c*) and the sparking voltage V exceeds the comparative level VCOMP between time points t5 and t11, as shown in FIG. 16 (*d*). As a result, the output VT from the pulse duration-measuring circuit 27 exceeds the reference voltage VTREF between time points t12–t4 as shown in FIG. 16 (*e*), thus detecting occurrence of a misfire.

The predetermined time period TD is set in dependence on engine operating parameters such as load on the engine, so as to avoid the peak-holding circuit 22 from being reset at a time point corresponding to a peak portion of the sparking voltage V which is caused by the recharging and indicated by symbol P in FIG. 16 (*c*), because the time duration of the peak portion P varies depending upon operating conditions of the engine.

According to this embodiment, even when the spark plug has just started smoking or just started recovering from a smoking state, an FI misfire can be positively detected.

Although in the above described embodiments the means for applying the recharging voltage to the spark plug is constructed such that the ignition coil 2 is energized and deenergized by a recharging command signal from the ECU 8 to apply high voltage to the spark plug 5, this is not limitative, but it may comprise any other type of high voltage-applying means such as one including a coil or the like provided separately from the ignition coil and adapted to apply high voltage to the spark plug after generation of the ignition command signal, in response to a recharging command signal.

What is claimed is:

1. In a misfire-detecting system for an internal combustion engine having at least one cylinder, and a spark plug provided in each of the at least one cylinder, said system including engine operating condition-detecting means for detecting values of operating parameters of said engine, signal-generating means for determining ignition timing of said engine, based upon values of operating parameters of said engine detected by said engine operating condition-detecting means and for generating an ignition command signal indicative of the determined ignition timing, igniting means responsive to said ignition command signal for generating high voltage for causing generation of sparking voltage across said spark plug for discharging said spark plug, voltage value-detecting means for detecting a value of said sparking voltage generated across said spark plug when said high voltage is generated by said igniting means, comparing means for comparing the detected value of said sparking voltage with a predetermined reference voltage value, measuring means for measuring a time period over which the detected value of said sparking voltage exceeds said predetermined reference voltage value, and misfire-determining means for determining that a misfire has occurred in said engine when the measured time period exceeds a predetermined time period value;

the improvement comprising:

recharging command signal-generating means for generating a recharging command signal for applying high voltage to said spark plug, after generation of the ignition command signal.

2. A misfire-detecting system as claimed in claim 1, including time period-limiting means for setting a comparison time period within which said comparison between the detected value of said sparking voltage and said predetermined reference voltage value is to be made, and wherein said misfire-determining means determines whether a misfire has occurred in said engine, based upon the measured time period obtained within said comparison time period.

3. A misfire-detecting system as claimed in claim 2, wherein said recharging command signal-generating means generates said recharging command signal within said comparison time period.

4. In a misfire-detecting system for detecting a misfire occurring in an internal combustion engine having at least one cylinder, and a spark plug provided in each of the at least one cylinder, engine operating condition-detecting means for detecting values of operating parameters of said engine, signal-generating means for determining ignition timing of said engine, based upon values of operating parameters of said engine detected by said engine operating condition-detecting means and generating an ignition command signal indicative of said determined ignition timing, and sparking voltage-generating means responsive to said ignition command signal for generating a high voltage for discharging said spark plug, voltage value-detecting means for detecting a value of sparking voltage generated across said spark plug when said high voltage is generated by said sparking voltage-generating means, comparing means for comparing between said detected sparking voltage value and a predetermined reference voltage value, and misfire-determining means for determining that a misfire has occurred in said engine, when said sparking voltage exceeds said predetermined reference voltage value;

the improvement comprising:

recharging command signal-generating means generating a recharging command signal for applying high voltage to said spark plug, after generation of said ignition command signal; and time period-limiting means for setting a comparison time period within which said comparison between the detected value of said sparking voltage and said predetermined reference voltage value is to be made, after generation of said recharging command signal.

5. A misfire-detecting system as claimed in claim 4, wherein said time period-limiting means sets starting timing of said comparison time period such that it starts immediately after generation of said recharging command signal.

6. A misfire-detecting system as claimed in claim 4, wherein said time period-limiting means sets starting timing of said comparison time period such that it starts when a predetermined time period elapses after generation of said recharging command signal.

7. A misfire-detecting system as claimed in claim 4, 5 or 6, wherein said misfire-determining means determines that a misfire has occurred, when a time period over which the detected value of said sparking voltage exceeds said predetermined reference voltage value within said comparative time period exceeds said predetermined time period value.

8. A misfire-detecting system as claimed in claim 4 or 6, wherein said misfire-determining means determines that a misfire has occurred, immediately when the detected value of said sparking voltage exceeds said predetermined reference voltage value within said comparative time period.

9. A misfire-detecting system as claimed in claim 2 or 4, wherein said time period-limiting means sets at least one of starting timing and terminating timing of said comparison time period in dependence on values of predetermined operating parameters of said engine.

10. A misfire-detecting system as claimed in claim 6, wherein said time period-limiting means sets said predetermined time period in dependence on values of predetermined operating parameters of said engine.

11. A misfire-detecting system as claimed in claim 1 or 4, wherein said recharging command signal-generating means generates said recharging command signal after termination of discharge caused by said ignition command signal.

12. A misfire-detecting system as claimed in claim 11, wherein said recharging command signal-generating means sets a time period between generation of said ignition command signal and generation of said recharging command signal in dependence on values of predetermined operating parameters of said engine.

13. A misfire-detecting system as claimed in claim 1 or 4, wherein said recharging command signal causes generation of a predetermined voltage across said spark plug, which has such a value as does not cause spark discharge.

14. A misfire-detecting system as claimed in claim 13, wherein said value of said predetermined voltage is set in dependence on values of predetermined operating parameters of said engine.

15. A misfire-detecting system as claimed in claim 14, wherein said predetermined operating parameters of said engine include at least one of rotational speed of said engine, load on said engine, and an output voltage from a battery which supplies power to said igniting means.

16. A misfire-detecting system as claimed in claim 1, wherein said misfire-determining means corrects said predetermined reference voltage value in dependence on an output voltage from a battery which supplies power to said igniting means.

17. A misfire-detecting system as claimed in any of claims 1–6, wherein said igniting means includes a distributor having a plurality of segments corresponding, respectively, to cylinders of said engine, and a rotor being rotatable in unison with rotation of said engine, said rotor having a circumferential size which is enlarged in a direction of retarding said ignition timing of said engine.

18. A misfire-detecting system as clammed in claim 17, wherein said circumferential size of said rotor falls within a range corresponding to a crank angle range of 50 degrees before a top dead center of each of said at least one cylinder of said engine to 40 degrees after said top dead center.

19. In a misfire-detecting system for an internal combustion engine having at least one cylinder, and a spark plug provided in each of said at least one cylinder, said system including engine operating condition-detecting means for detecting values of operating parameters of said engine, signal-generating means for determining ignition timing of said engine, based upon values of operating parameters of said engine detected by said engine operating condition-detecting means and for generating an ignition command signal indicative of the determined ignition timing, igniting means responsive to said ignition command signal for generating high voltage for causing generation of sparking voltage across said spark plug for discharging said spark plug, voltage value-detecting means for detecting a value of said sparking voltage generated across said spark plug when said high voltage is generated by said igniting means, comparing means for comparing the detected value of said sparking voltage with a predetermined reference voltage value, measuring means for measuring a time period over which the detected value of said sparking voltage exceeds said predetermined reference voltage value, and misfire-determining means for determining that a misfire has occurred in said engine when the measured time period exceeds a predetermined time period value;

the improvement comprising:

recharging command signal-generating means for generating a recharging command signal for applying high voltage to said spark plug, after generation of the ignition command signal; and initializing means for initializing said predetermined reference voltage value almost simultaneously with generation of said recharging command signal.

20. In a misfire-detecting system for an internal combustion engine having at least one cylinder, and a spark plug provided in each of said at least one cylinder, said system including engine operating condition-detecting means for detecting values of operating parameters of said engine, signal-generating means for determining ignition timing of said engine, based upon values of operating parameters of said engine detected by said engine operating condition-detecting means and for generating an ignition command signal indicative of the determined ignition timing, igniting means responsive to said ignition command signal for generating high voltage for causing generation of sparking voltage across said spark plug for discharging said spark plug, voltage value-detecting means for detecting a value of said sparking voltage generated across said spark plug when said high voltage is generated by said igniting means, comparing means for comparing the detected value of said sparking voltage with a predetermined reference voltage value, measuring means for measuring a time period over which the detected value of said sparking voltage exceeds said predetermined reference voltage value, and misfire-determining means for determining that a misfire has occurred in said engine when the measured time period exceeds a predetermined time period value;

the improvement comprising:

recharging command signal-generating means for generating a recharging command signal applying high voltage to said spark plug, after generation of the ignition command signal; and initializing means for initializing said predetermined reference voltage value when a predetermined time period elapses after generation of said recharging command signal.

21. A misfire-detecting system as claimed in claim 20, wherein said initializing means sets said predetermined time period in dependence on values of predetermined operating parameters of said engine.

22. A misfire-detecting system as claimed in claim 20 or 21, wherein said recharging command signal-generating means generates said recharging command signal after termination of discharge caused by said ignition command signal.

* * * * *